US006290167B1

(12) United States Patent
Garcia et al.

(10) Patent No.: US 6,290,167 B1
(45) Date of Patent: Sep. 18, 2001

(54) APPARATUS AND METHOD FOR PREVENTING YARN TAIL BREAKAGE DURING YARN WINDING

(75) Inventors: Israel Fernandez Garcia, Barcelona (ES); Alonso Ganan, Matthews, NC (US)

(73) Assignee: Conitex-Sonoco U.S.A., Inc., Gastonia, NC (US)

( * ) Notice: Subject to any disclaimer, the term of this patent is extended or adjusted under 35 U.S.C. 154(b) by 0 days.

(21) Appl. No.: 09/526,932

(22) Filed: Mar. 16, 2000

(51) Int. Cl.[7] ..... B65H 54/42; B65H 49/00

(52) U.S. Cl. ..... 242/486.2; 242/129.51; 242/596.7

(58) Field of Search ..... 242/129.5, 486.2, 242/596.7

(56) References Cited

U.S. PATENT DOCUMENTS

| | | | | |
|---|---|---|---|---|
| 1,693,876 | | 12/1928 | Unruh . | |
| 1,975,743 | | 10/1934 | Gollong . | |
| 2,380,644 | * | 7/1945 | Grondona | 242/596.7 |
| 2,898,054 | | 8/1959 | Rea . | |
| 2,983,461 | * | 5/1961 | Kray et al. | 242/129.51 X |
| 3,613,880 | * | 10/1971 | Perrin | 242/596.7 X |
| 3,770,221 | * | 11/1973 | Stern | 242/596.7 X |
| 3,801,038 | | 4/1974 | Wüst . | |
| 3,809,326 | | 5/1974 | Wüst . | |
| 3,831,869 | | 8/1974 | Satori . | |
| 4,125,229 | | 11/1978 | Dillon . | |
| 4,299,357 | | 11/1981 | Munker . | |
| 4,327,874 | * | 5/1982 | Bruno | 242/129.51 X |
| 4,328,928 | | 5/1982 | Zang . | |
| 4,477,034 | | 10/1984 | Oswald . | |
| 4,700,834 | | 10/1987 | Martinez . | |
| 4,700,904 | | 10/1987 | Martinez . | |
| 4,793,567 | * | 12/1988 | Weiss et al. | 242/596.7 |
| 4,819,892 | | 4/1989 | Schürmann et al. . | |
| 4,832,281 | | 5/1989 | Payne, Jr. et al. . | |
| 5,014,928 | | 5/1991 | Gandy et al. . | |
| 5,169,080 | | 12/1992 | Bartkowiak . | |
| 5,170,961 | | 12/1992 | Bolz et al. . | |
| 5,711,142 | | 1/1998 | Cromartie . | |
| 5,875,626 | * | 3/1999 | Cromartie | 242/129.51 X |

FOREIGN PATENT DOCUMENTS

| | | |
|---|---|---|
| 2536477 | 7/1976 | (DE) . |
| 2747771 | 7/1978 | (DE) . |
| 53755 | 4/1979 | (JP) . |
| 404182274 | 6/1992 | (JP) . |
| 231011 | 11/1986 | (SU) . |

OTHER PUBLICATIONS

Sonoco Products, Sonoco: Eliminator to Curb Cut Yarn Tails; Textile World; Publication date was prior to the date this application was filed; pp. 30 & 32; no other information available.

* cited by examiner

*Primary Examiner*—Michael R. Mansen
(74) *Attorney, Agent, or Firm*—Adams, Schwartz & Evans, P.A.

(57) ABSTRACT

In a yarn carrier holder for holding a yarn carrier during rotation of the yarn carrier as yarn is wound thereon, the improvement which includes serrations carried by the yarn carrier holder for cooperating with complementary serrations in the base of the yarn carrier for locking the yarn carrier against motion relative to the carrier holder.

6 Claims, 8 Drawing Sheets

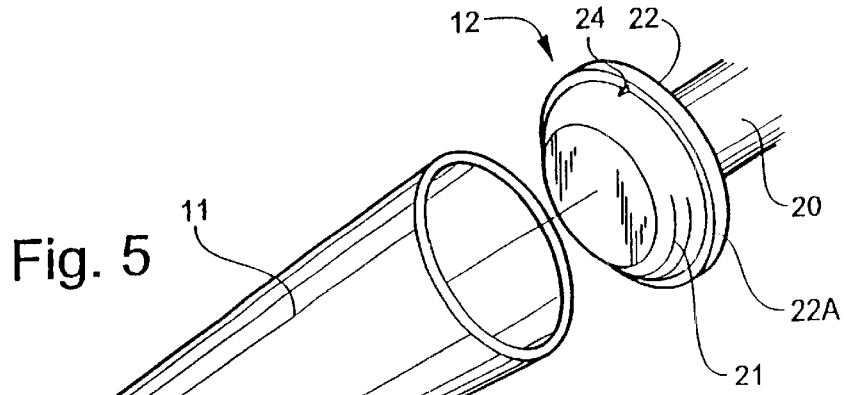
Fig. 5
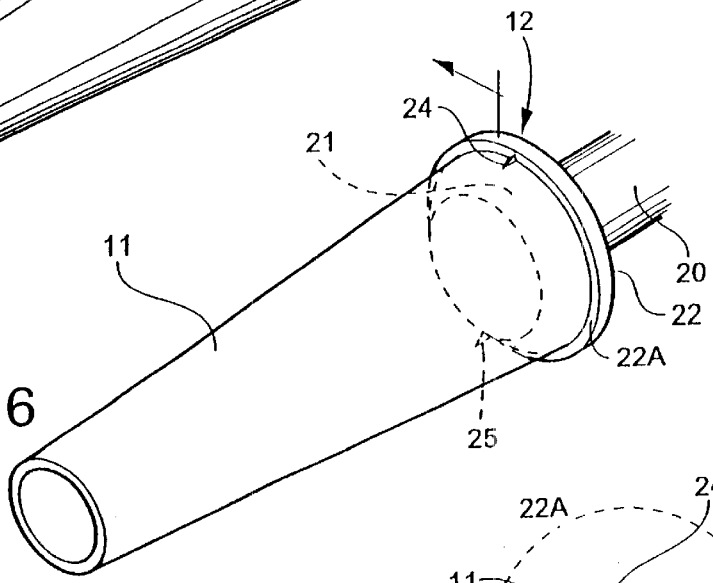
Fig. 6
Fig. 7A
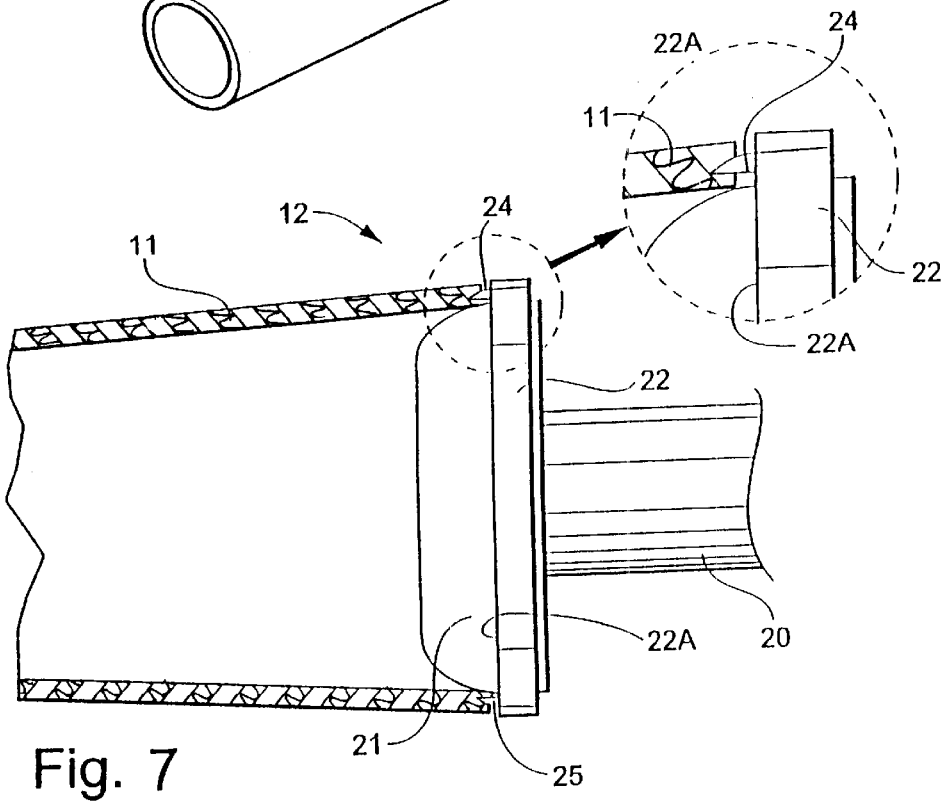
Fig. 7

APPARATUS AND METHOD FOR PREVENTING YARN TAIL BREAKAGE DURING YARN WINDING

TECHNICAL FIELD AND BACKGROUND OF THE INVENTION

This invention relates to a method and product for preventing yarn tail breakage during yarn winding. The invention disclosed in this application has particular utility in the winding of yarn carriers, for example cylindrical or conical tubes, with yarn intended for knitting or weaving. Winding takes place in open-end spinning, twisting and other processes wherein yarn is wound onto the carriers. Yarn carriers used in these processes are wound with a trailing "tail" of yarn which the end of yarn on an exhausted carrier to be tied to the leading end of yarn on the succeeding full package. The tail is necessary if the transfer from the exhausted to a full package is to take place without dropping needles, which causes a serious defect in the knitted fabric.

While the invention disclosed in this application has utility on a number of different types of yarn carriers, for purposes of illustration the invention will be described with reference to a tubular textile yarn package which is formed of pressed paper and has a generally frusto-conical shape. While carriers come in various configurations, one common type of carrier is a cone which has an angle of taper of 5 degrees, 57 minutes.

As described above, this type of carrier must be wound with a tail in order for it to be considered a first quality package. An acceptable rate of yarn tail breakage is about one percent, with between two and three percent being average. Since knitters require yarn packages with yarn tails, yarn tail breakage is a serious problem both from the standpoint of yarn quality and from the standpoint of increased cost to the processor which results from back-winding defective packages, returns from customers, and the like.

The yarn tail is usually formed by taking a length of yarn and extending part of it over the open mouth of the large end of the carrier. The carrier is then applied to a cradle which has a carrier holder base plate which fits into the large end of the carrier and holds the yarn, and a carrier holder nose plate which secures the carrier for proper rotation about a fixed axis. The carrier is wound by surface drive against a rotating drum which feeds the yarn onto the rotating carrier in a predetermined pattern. This assembly is referred to generally herein as a "yarn carrier holder."

Until relatively recently, winders were designed so that the carrier holder base plate had an internal taper which corresponded to the taper of the carrier. This meant that for a fairly substantial distance on the order of ¼ of an inch, the surface of the carrier holder base plate and the inner surface of the carrier were parallel with each other and in flush contact. The yarn trapped across the mouth of the carrier was thereby held firmly along the entire length of contact between the carrier and the base plate. This resulted in a secure grip while, at the same time, any stress applied to the yarn was spread over a relatively long distance.

Some winder manufacturers have designed cradles which have universal carrier holder base plates and nose plates. The plates are adapted to receive carriers having various angles of taper without the additional labor and lost operating time required to conform the cradle to the precise type of carrier being wound. While substantial efficiencies are achieved by this new type of winder, the angle of the portion of the base plate which fits into the large end of the carrier is no longer necessarily parallel to and flush with the inner surface of the carrier. Therefore, the yarn tail passes between the carrier and the base plate at two diametrically opposed edges rather than wide, flush surfaces. As long as there is little or no relative movement between the base plate and carrier, this fact is of little consequence. Therefore, when starting an empty carrier, there is often little difficulty since the carrier itself is very lightweight and has very little inertia.

Accordingly, the carrier begins rotation with the base plate and there is little or no relative movement which could cause the yarn to be pinched or cut. However, as yarn is wound onto the carrier, it increases substantially in weight and inertia. Many winders have automatic stop motions which utilize, for example, an air brake to very quickly stop the rotation of carrier when the package is full or when a break in the yarn occurs. The substantial inertia created by a full or near-full package is sufficient to cause the package to rotate relative to the base plate during stopping and starting. In the new types of winders described above, the edge of the base plate which presses against the yarn exerts a substantial amount of force and is more than sufficient to cut the yarn in two. As a result, the yarn package is no longer first quality and must either be rewound or sold as second quality.

Murata winders are widely used in the textile industry and present a unique, potential cause of yarn tail breaks. Murata winders include a rubber drive ring which sits on one end of the yarn carrier holder and, when the carrier is donned, sits against the adjacent end of the carrier. The drive ring contacts the driving surface of the drum during the initial winding phase and causes the carrier to rotate. When enough yarn has been built up on the carrier, the diameter of the carrier becomes greater than the diameter of the drive ring, and thus the carrier is thereafter rotated by direct contact between the carrier and the drum. It has been observed that the rubber ring will sometimes cut the yarn tail both during starting and stopping due to the contact between the rubber ring and the end edge of the carrier across which the yarn tail extends. The problem has become progressively worse as the winding speed of modern winders, open-end spinning machines, twisters, and the like have increased.

An earlier solution to this problem has been to make the yarn carriers slightly undersized so that the end of the carrier does not contact the rubber ring. However, this can cause misalignment problems and requires that the carrier manufacturer make a special carrier just for Murata winders. This increases the cost of the carrier and related inventory control costs to both the manufacturer and the yarn producer.

Applicant has reduced this problem to a significant extent by modifying the design of the carrier to incorporate grooves into the end of the carriers which protect the yarn by providing a slight recess in which the yarn at least partially resides thereby reducing the force on the yarn. This development is exemplified in applicant's prior U.S. Pat. No. 4,700,904.

The invention described in this application provides further improvement in yarn carrier quality easily, efficiently and inexpensively.

SUMMARY OF THE INVENTION

Therefore, it is an object of the invention to provide a textile yarn carrier holder which prevents breakage of the yarn tail of a yarn carrier during a winding process.

It is another object of the invention to provide a yarn carrier holder for a tubular textile yarn carrier which is particularly adapted for use on winders of the type having yarn carrier holders which include a rubber drive ring which provides surface-to-surface driving contact for the carrier during the initial winding phase.

It is another object of the present invention to provide a method of preventing breakage of yarn tails on tubular textile carriers occasioned by relative movement between the textile carrier and the carrier holder on which it is mounted for rotation.

It is another object of the present invention to provide a method of preventing breakage of yarn tails on tubular textile carriers by locking the carrier to the carrier holder whereby relative rotational movement between the carrier and the carrier holder on which it is mounted for rotation is prevented.

These and other objects of the present invention are achieved in the preferred embodiments disclosed below by providing in a yarn carrier holder for holding a yarn carrier during rotation of the yarn carrier as yarn is wound thereon, the improvement comprising serrations carried by the yarn carrier holder for cooperating with complementary serrations in the base of the yarn carrier for locking the yarn carrier against motion relative to the carrier holder.

According to one preferred embodiment of the invention, the serrations comprise axially-extending, symmetrically-formed teeth.

According to another preferred embodiment of the invention, the serrations comprise axially-extending, asymmetrically-formed teeth.

According to yet another preferred embodiment of the invention, the asymmetrically-formed teeth have a first shoulder facing in the direction of rotation of the yarn carrier holder and parallel to the axis of rotation of the yarn carrier holder and a second shoulder facing in the direction opposite the direction of rotation of the yarn carrier holder, the second shoulder extending obliquely to axis of rotation of the yarn carrier holder.

According to yet another preferred embodiment of the invention, the carriers are constructed of paper.

According to yet another preferred embodiment of the invention, the carrier holder operates on a textile winder.

According to yet another preferred embodiment of the invention, the carrier holder operates on an open-end spinning machine.

An embodiment of the method of preventing breakage of yarn tails on textile yarn carriers according to the invention comprises the steps of providing serrations on a yarn carrier-engaging surface of the yarn carrier holder for cooperating with complementary serrations formed in the base of the yarn carrier, donning a yarn carrier having a yarn tail extending across the end of the carrier onto the yarn carrier holder at the beginning of a yarn-winding process, engaging the serrations of the yarn carrier holder with the complementary serrations on the yarn carrier during the donning step for locking the yarn carrier against rotational movement relative to the yarn carrier holder, winding yarn onto the yarn carrier, and disengaging the yarn carrier from the yarn carrier holder during a doffing step.

BRIEF DESCRIPTION OF THE DRAWINGS

Some of the objects of the invention have been set forth above. Other objects and advantages of the invention will appear as the invention proceeds when taken in conjunction with the following drawings, in which:

FIG. 5 is a perspective view showing the manner in which the yarn carrier and yarn carrier holder fit together;

FIG. 6 is a perspective view showing the yarn carrier and yarn carrier holder in position together;

FIG. 7 is a vertical cross-sectional view of the yarn carrier and yarn carrier holder as shown in FIG. 6;

FIG. 7A is a further fagmentary enlargement of the point of penetration of the locking pin into the paper of the yarn carrier shown in FIG. 7;

DESCRIPTION OF THE PREFERRED EMBODIMENT AND BEST MODE

Figure 1:
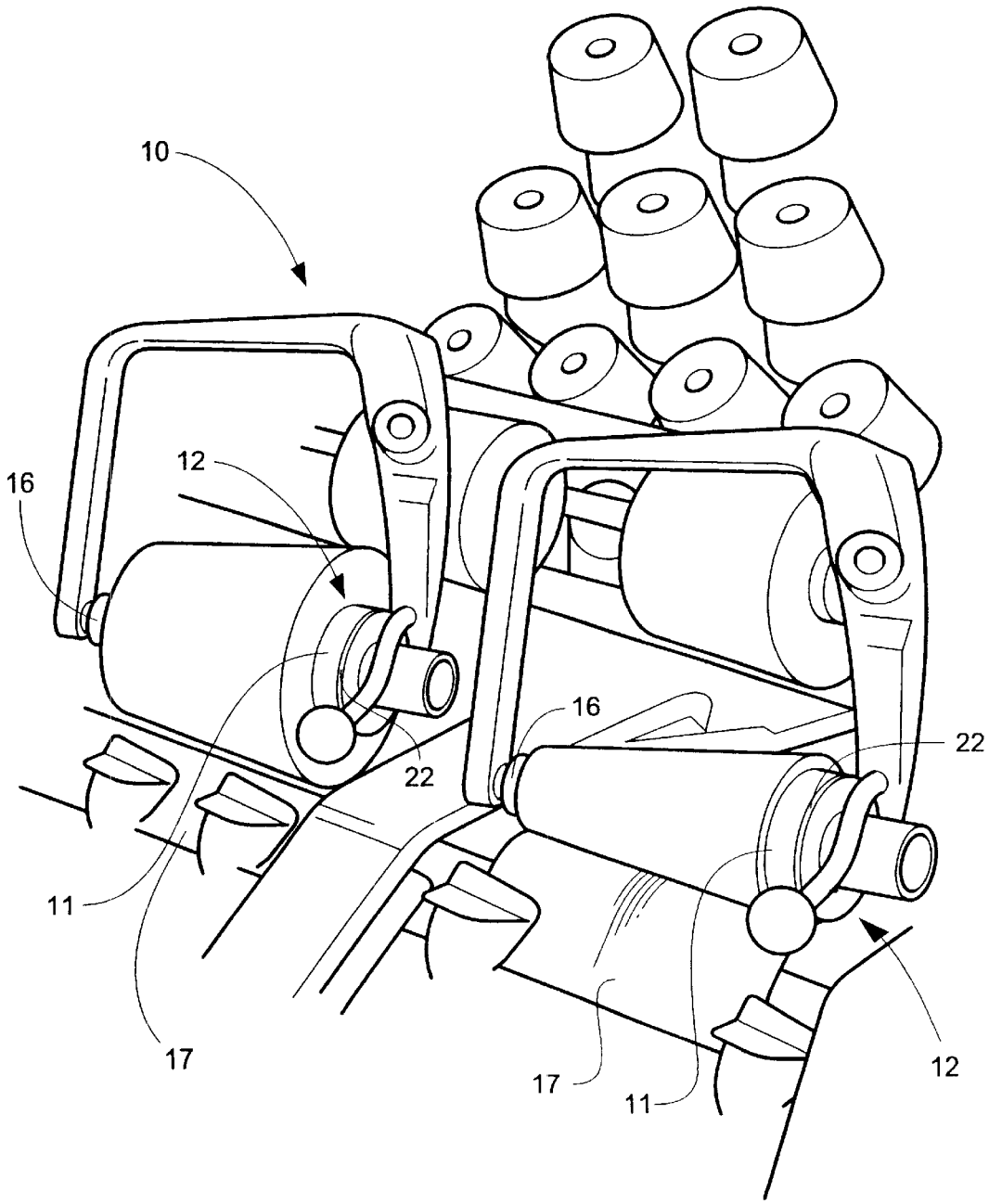
FIG. 1 is a fragmentary perspective view of a winder of a type on which the invention has application.

Referring now specifically to the drawings, a Murata winder of the type which incorporates the present invention is illustrated in FIG. 1 and shown generally at reference numeral 10. A yarn carrier 11, such as a 5 degree, 57 minute paper yarn cone is donned by first forming a yarn tail by taking a length of yarn and extending part of it over the open mouth of the large end of the carrier 11. The carrier 11 is then applied to a carrier holder 12, which includes a base 21 which fits into the large end of the carrier 11, trapping the yarn across the large end of the carrier 11. The other end of the carrier 11 is held by a carrier holder nose plate 16 which secures the other end of the carrier 11 for proper rotation about a fixed axis. The carrier 11 is wound by surface drive against a rotating drum 17 which feeds the yarn onto the rotating carrier 11 in a predetermined pattern, or "wind."

Figure 2:
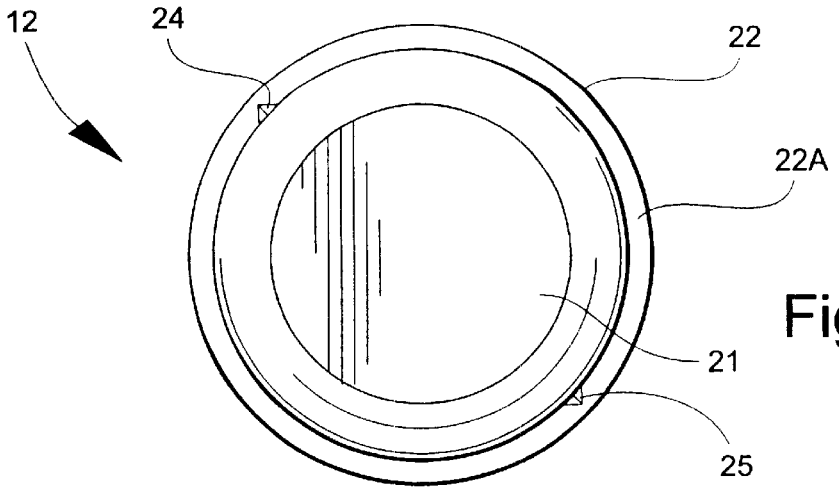
FIG. 2 is a front plan view of a Murata yarn carrier holder according to an embodiment of the invention.
Figure 3:
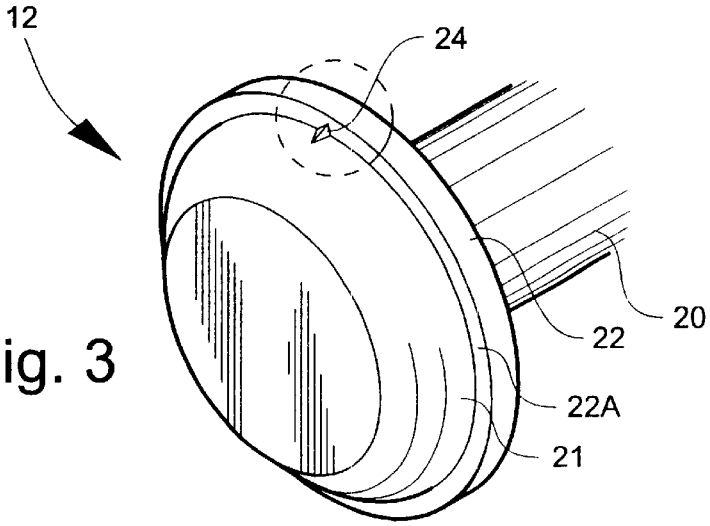
FIG. 3 is a perspective view of a Murata yarn carrier holder according to an embodiment of the invention.

Referring now to FIGS. 2 and 3, the Murata base 21 of FIG. 1 is shown. The base 21 includes a spindle 20 on which is mounted a curving, tapered surface of polished stainless steel. A rubber drive ring 22 is molded to the base 21 at the point of greatest diameter. As noted above, the carrier 11 is donned onto the carrier holder 12 with the large end of the carrier abutting the adjacent radial surface 22A of the drive ring 22. It is the abutment of these two surfaces that traps the yarn tail, and can cause yarn tail breakage during starting and stopping of the winder 10.

Figure 4:
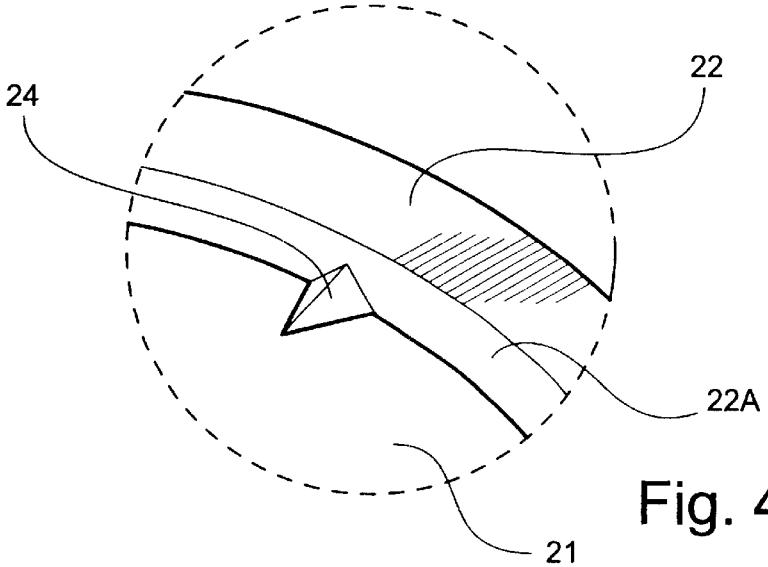
FIG. 4 is an enlarged fragmentary perspective view of a Murata yarn carrier holder according to an embodiment of the invention as shown in FIGS. 2 and 3.

As is shown in FIGS. 2, 3 and 4, a pair of sharp metal pins 24 and 25 are inserted into the radial surface 22A of the drive ring 22 at diametrically opposed points on the periphery of the drive ring 22. The pins 24 and 25 are preferably held in place by epoxy cement or some other suitable means of attachment. The pins 24 and 25 are spaced very slightly above the level of the surface of the adjacent base 21 so that the pin will penetrate into the end edge of the carrier 11. Alternatively, the pins 24 and 25 may be placed closer to the level of the surface of the base 21, so that the pins wedge themselves into the opening of the carrier 11.

While one such pin 24 or 25 would be suitable in many applications, it is believed that a plurality of at least two pins will more adequately lock the carrier 11 to the carrier holder base 21 under the widest variety of processing conditions. Of course, the symmetry of placement of the pins 24 and 25 and the exact number used are a matter of choice.

Referring now to FIGS. 5 and 6, the manner in which the carrier 11 fits onto the base 21 is more specifically illustrated. As is shown in FIG. 7, and particularly the enlarged, fragmentary portion of FIG. 7A, the pin 24 penetrates into the end edge of the carrier 11. Of course, the pin 25 penetrates into the diametrically opposite end edge of the carrier 11 in the same manner. This penetration takes place during donning and thus before rotation of the carrier 11 begins, thereby preventing relative rotational movement between the carrier 11 and the base 21.

Figure 8:
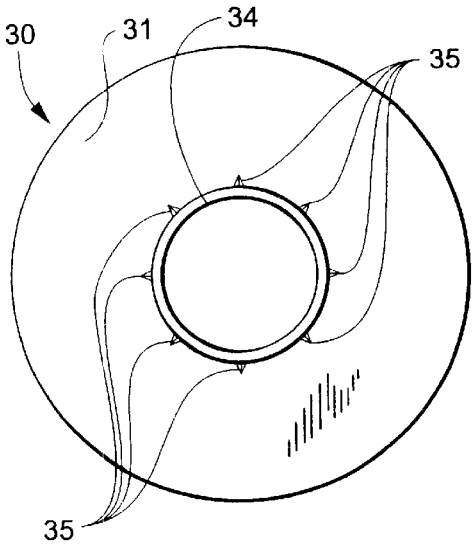
FIG. 8 is a front plan view of a carrier holder for cylindrical yarn carriers used in air jet spinning.
Figure 9:
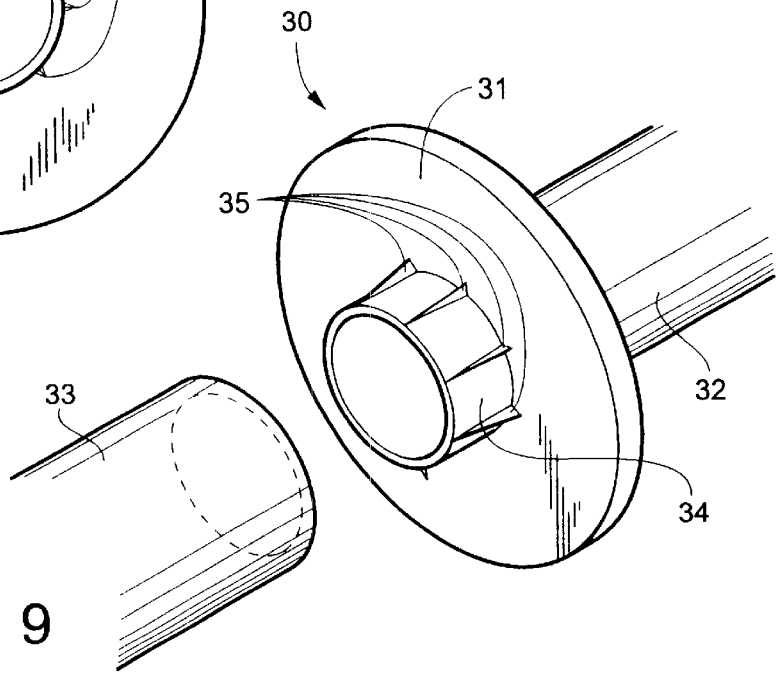
FIG. 9 is a perspective view showing the manner in which the yarn carrier and yarn carrier holder of FIG. 8 fit together.
Figure 10:
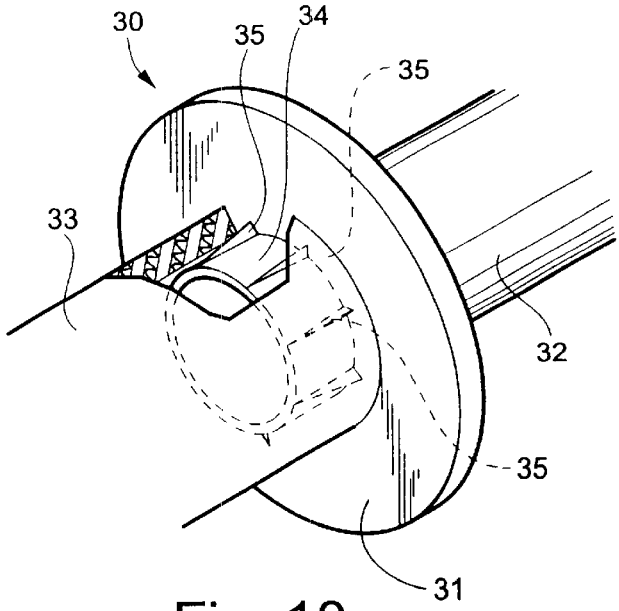
FIG. 10 is a perspective view, with parts broken away, showing the yarn carrier and yarn carrier holder in position together.
Figure 11:
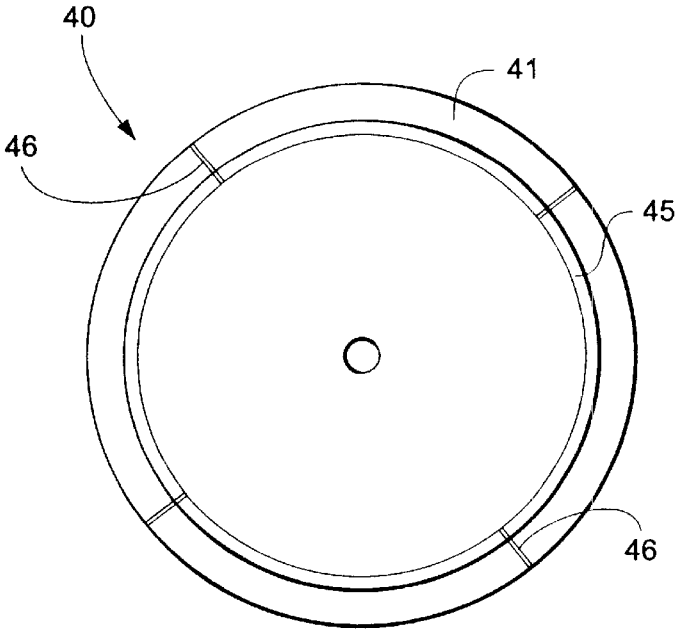
FIG. 11 is a front plan view of a carrier holder for open end spinning processes utilizing plastic yarn carriers.
Figure 12:
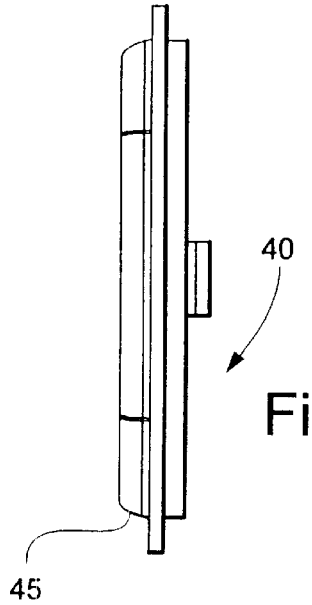
FIG. 12 is a side elevation of a carrier holder for open end spinning processes utilizing plastic yarn carriers.
Figure 13:
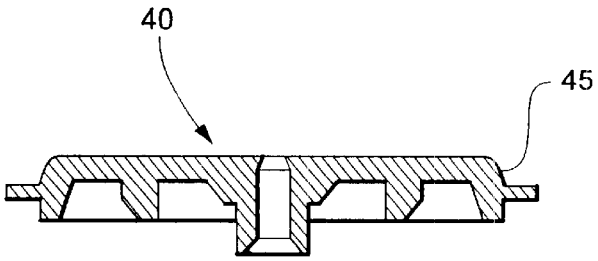
FIG. 13 is a cross-sectional view of the carrier holder shown in FIG. 11.

The same principle can be applied in other related processes and with differing carrier holders. Referring to FIGS. 8, 9 and 10, an air jet spinning carrier holder 30 is shown which includes a nose flange 31 carried on a spindle 32. This embodiment is particularly useful on a Murata air jet spinning machine. A paper cylindrical carrier 33 is supported on a cylindrical base 34. Base 34 is provided with eight equally spaced, tapered ribs 35 extending axially along the surface of the base 34. Preferably, the ribs 35 rise from the surface of the base 34 towards the nose flange 31. In other words, there are no ribs at the outer edge of the base 34, but they begin and increase to a height of 0.3 mm at the nose flange 31. This embodiment is particularly useful with plastic carriers 33, which are harder than paper and thus are more difficult to penetrate. The progressive increase in the height of the ribs 35 causes a wedging effect as the carrier 33 is donned onto the base 34, and a penetration into the surface of the carrier 33 by the ribs 35 of a maximum of 0.3 mm. This is best illustrated in FIG. 10. Other numbers and configurations of ribs 35 can also be used.

Figure 14:
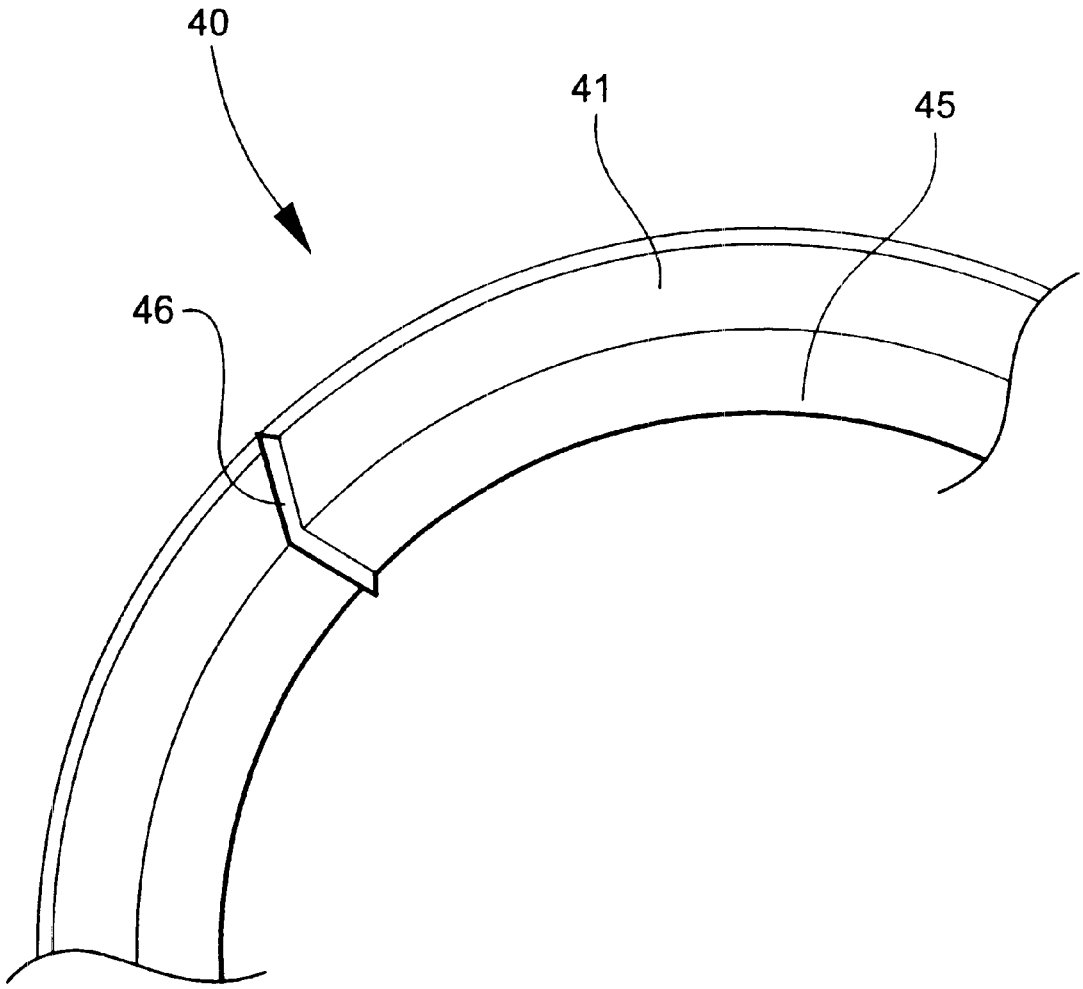
FIG. 14 is a fragmentary perspective view of the penetration means of the carrier holder shown in FIG. 11.

Referring now to FIGS. 11 through 14, a further illustration of the invention is provided. A carrier holder 40 intended for use in an open end spinning is shown which includes a nose flange 41. A cylindrical or conical yarn carrier (not shown) is supported for rotation on the nose flange 41. Nose flange 41 includes a tapered mounting shoulder 45 over which the carrier is forced. The mounting shoulder 45 is provided with four equally spaced ribs 46 which extend axially along the surface of the mounting shoulder 45 and also outwardly from the point where the mounting shoulder 45 meets the radially-outwardly extending portion of the nose flange 41, thus forming an "L" shaped rib which engages both the inner wall and the end edge of the yarn carrier. This is best shown in FIG. 14.

Figure 15:
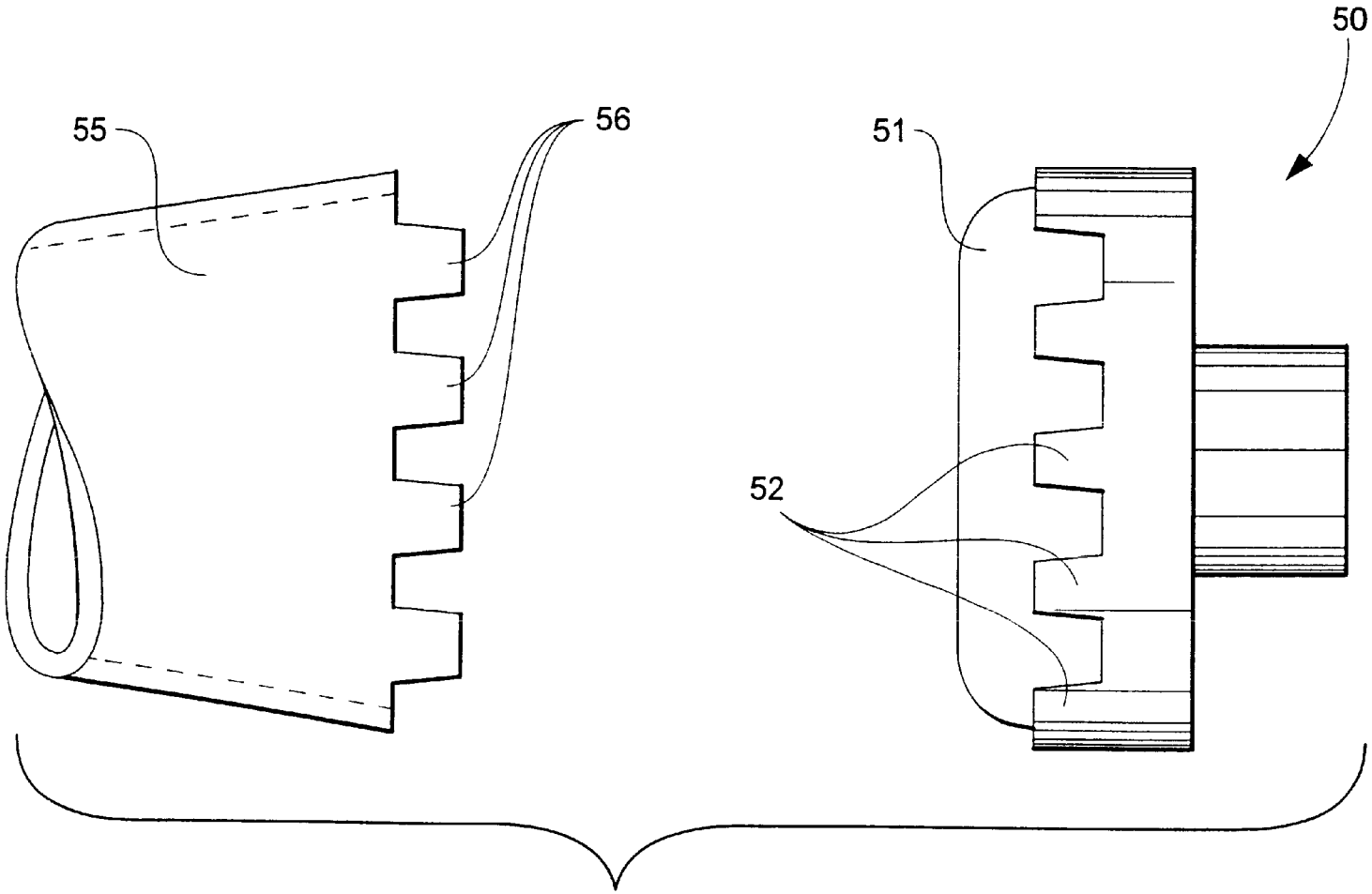
FIG. 15 is a fragmentary side view of paper cone and a carrier holder according to an alternative embodiment of the invention.

Referring now to FIG. 15, a further embodiment is illustrated. A carrier holder 50 includes a tapered mounting surface 51 and a series of regularly-spaced and alternating serrations 52. A yarn package, such as a cone 55, is provided with a matching set of serrations 56 which mate with the serrations on the carrier holder 50 to provide a positive lock against relative rotation of the cone 55 and the carrier holder 50. As described above, the yarn is trapped between the outer surface of the carrier holder 50 and the inner surface of the cone 55. The lack of relative movement between the carrier holder 50 and cone 55 prevents yarn breakage resulting from rubbing or cutting.

Figure 16:
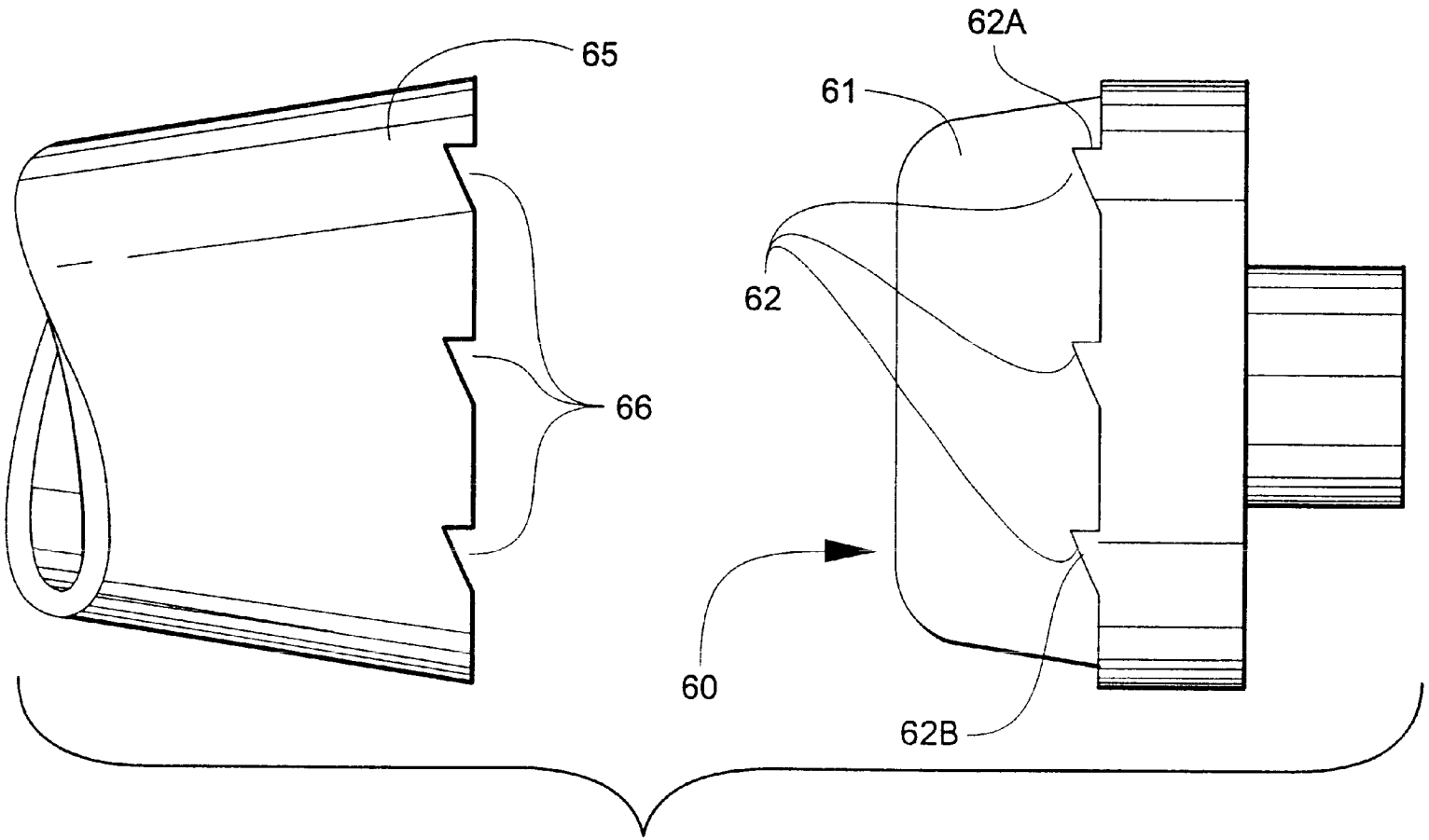
FIG. 16 is a fragmentary side view of paper cone and a carrier holder according to a further alternative embodiment of the invention.

Referring now to FIG. 16, yet a further embodiment is illustrated. A carrier holder 60 includes a tapered mounting surface 61 and a series of regularly-spaced and alternating serrations 62. A yarn package, such as a cone 65, is provided with a matching set of serrations 66 which mate with the serrations on the carrier holder 60 to provide a positive lock against relative rotation of the cone 65 and the carrier holder 60. The serrations 62 on the carrier holder 60 are angled in the direction of rotation of the carrier holder, the forward shoulder 62A of each serration 62 being at right angles to the mounting surface 61 of the carrier holder 60 and the trailing shoulder 62B of each serration 62 being tapered, as shown in FIG. 16. The serrations 66 of the cone 65 have a complementary shape so that the serrations 62 will lock into the complementary serrations 66 and thus cease relative movement.

As described above, the yarn is trapped between the outer surface of the carrier holder 60 and the inner surface of the cone 65. The lack of relative movement between the carrier holder 60 and cone 65 prevents yarn breakage resulting from rubbing or cutting.

An apparatus and method for preventing yarn tail breakage during yarn winding is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A yarn carrier holder adapted for holding a yarn carrier of the type having a plurality of asymmetrically-extending recesses formed on an end edge of a yarn carrier for locking the yarn carrier against motion relative to said yarn carrier holder, wherein the yarn carrier holder comprises:

(a) a rotatably-mounted base; and (b) a plurality of asymmetrically-extending teeth formed on an edge of said rotatably-mounted base for complementary engagement with the recesses on the end edge of the yarn carrier, wherein each of said asymmetrically-extending teeth comprises:

(i) a first wall extending perpendicularly to and outwardly from the base and parallel to the axis of rotation of the yarn carrier holder; and (ii) a second wall integrally formed with and positioned adjacent to said first wall, said second wall extending obliquely to the plane of the base and in the direction of rotation of the yarn carrier holder and intersecting with the first wall to form a point.

2. In combination with a textile winder, a yarn carrier holder according to claim 1.

3. In combination with an open-end spinning machine, a yarn carrier holder according to claim 1.

4. A yarn carrier adapted for use on a yarn carrier holder of the type having a plurality of asymmetrically-extending teeth formed in an edge on a rotatably-mounted yarn carrier holder base for locking said yarn carrier against motion relative to the yarn carrier holder, the yarn carrier comprising a plurality of asymmetrically-extending recesses formed on an end edge thereof for complementary engagement with the teeth on the rotatably-mounted yarn carrier holder base, wherein each of said asymmetrically-extending recesses comprises:

(a) a first wall extending perpendicularly to and inwardly from the end edge and parallel to the axis of rotation of the yarn carrier holder; and (b) a second wall integrally formed with and positioned adjacent to said first wall, said second wall extending obliquely to the plane of the end edge and in the direction of rotation of the yarn carrier holder and intersecting with the first wall to form a point.

5. A yarn carrier according to claim 4, wherein said yarn carrier is constructed of paper.

6. A method of preventing breakage of yarn tails on a textile yarn carrier occasioned by relative movement between a rotatably-mounted yarn carrier holder on which the yarn carrier is mounted by insertion of the yarn carrier holder in one end thereof, comprising the steps of:

(a) providing a yarn carrier comprising a plurality of asymmetrically-extending recesses formed on an end edge thereof, each of said asymmetrically-extending recesses comprising:

(i) a first wall extending perpendicularly to and inwardly from the end edge and parallel to the axis of rotation of the yarn carrier holder; and (ii) a second wall integrally formed with and positioned adjacent to said first wall, said second wall extending obliquely to the plane of the end edge and in the direction of rotation of the yarn carrier holder and intersecting with the first wall to form a point;

(b) providing a yarn carrier holder comprising:

(i) a rotatably-mounted base; and (ii) a plurality of asymmetrically-extending teeth formed on an edge of said rotatably-mounted base for complementary engagement with the recesses on the end edge of the yarn carrier, wherein each of said asymmetrically-extending teeth comprises:

(aa) a first wall extending perpendicularly to and outwardly from the base and parallel to the axis of rotation of said yarn carrier holder; and (bb) a second wall integrally formed with and positioned adjacent to said first wall, said second wall extending obliquely to the plane of the base and in the direction of rotation of the yarn carrier holder and intersecting with the first wall to form a point;

(b) donning a yarn carrier having a yarn tail extending across an end thereof onto the yarn carrier holder at the beginning of a yarn-winding process;

(c) engaging the asymmetrically-extending teeth of the yarn carrier holder with the complementary recesses on the end edge of the yarn carrier during the donning step for locking the yarn carrier against rotational movement relative to the yarn carrier holder;

(d) winding yarn onto the yarn carrier; and (e) disengaging the yarn carrier from the yarn carrier holder during a doffing step.

* * * * *